United States Patent [19]

Schechter

[11] Patent Number: 4,583,508

[45] Date of Patent: Apr. 22, 1986

[54] POSITIVE DISPLACEMENT ELECTRONIC FUEL INJECTION PUMP

[75] Inventor: Michael M. Schechter, Southfield, Mich.

[73] Assignee: Ford Motor Company, Dearborn, Mich.

[21] Appl. No.: 689,359

[22] Filed: Jan. 7, 1985

[51] Int. Cl.[4] ..... F02M 41/00

[52] U.S. Cl. ..... 123/449; 123/458; 123/459; 123/506

[58] Field of Search ..... 123/449, 458, 459, 506, 123/495, 450

[56] References Cited

U.S. PATENT DOCUMENTS

| | | | |
|---|---|---|---|
| 2,223,759 | 12/1940 | Dillstrom | 123/449 |
| 2,980,092 | 4/1961 | Dreisin et al. | 123/449 |
| 3,142,261 | 7/1964 | May | 123/449 |
| 3,312,209 | 4/1967 | Chmura | 123/449 |
| 3,848,576 | 11/1974 | Hofer | 123/449 |
| 4,357,925 | 11/1982 | Woodruff | 123/450 |
| 4,407,249 | 10/1983 | Eheim | 123/450 |
| 4,412,519 | 11/1983 | Hoch et al. | 123/449 |
| 4,459,963 | 7/1984 | Gross et al. | 123/459 |
| 4,505,240 | 3/1985 | Shinoda et al. | 123/357 |

*Primary Examiner*—Magdalen Y. C. Moy

*Attorney, Agent, or Firm*—Clifford L. Sadler; Robert E. McCollum

[57] ABSTRACT

A positive displacement fuel injection pump having a single plunger moving fuel into and out of a fuel chamber by way of plunger internal passages being connected one at a time with a fuel supply passage and disconnected from a fuel injection line, and vice-versa upon rotation of the plunger, a solenoid valve controlling pressurization of the fuel chamber and effecting the injection of fuel through individual nozzles connected to the engine air stream adjacent an individual cylinder, the plunger internal passages including an outlet check valve controlling the fuel flow to the nozzles.

3 Claims, 8 Drawing Figures

POSITIVE DISPLACEMENT ELECTRONIC FUEL INJECTION PUMP

This invention relates in general to a fuel injection pump in which the fuel is injected under pressure into the flow of intake air before it is inducted into the cylinders of an internal combustion engine. In particular, it refers to a positive displacement type pumping system in which fuel is injected by a single, continuously rotating plunger is precisely measured discrete amounts at pre-selected times and in predetermined sequences through a plurality of injection nozzles, as controlled by a single solenoid spill valve, each of the nozzles being located close to the air inlet into an individual cylinder of a multicylinder engine.

Single plunger, rotating fuel injection pumps of the spill port type are known. For example, U.S. Ser. No. 689,127 shows and describes such a pump. However, it has intermittent rather than continuous rotation only on the downstroke of the pump. The fuel distribution is controlled by a solenoid valve and injected past individual fuel delivery valves. In the present case, the plunger rotates continously and contains a single fuel outlet check valve for delivery of fuel to individual fuel injection nozzles at the engine cylinders.

It is, therefore, a primary object of the invention to provide a fuel injection pump of the plunger, spill port type consisting of a single continuously rotating plunger having a single fuel outlet check valve in the plunger operable to control fuel flow successively to a number of fuel nozzles from which the fuel is supplied to individual cylinders, the fuel flow being controlled by a single solenoid valve controlled fuel spill port.

Other objects, features and advantages of the invention will become more apparent upon reference to the succeeding, detailed description thereof, and to the drawings, wherein.

Figure 1:
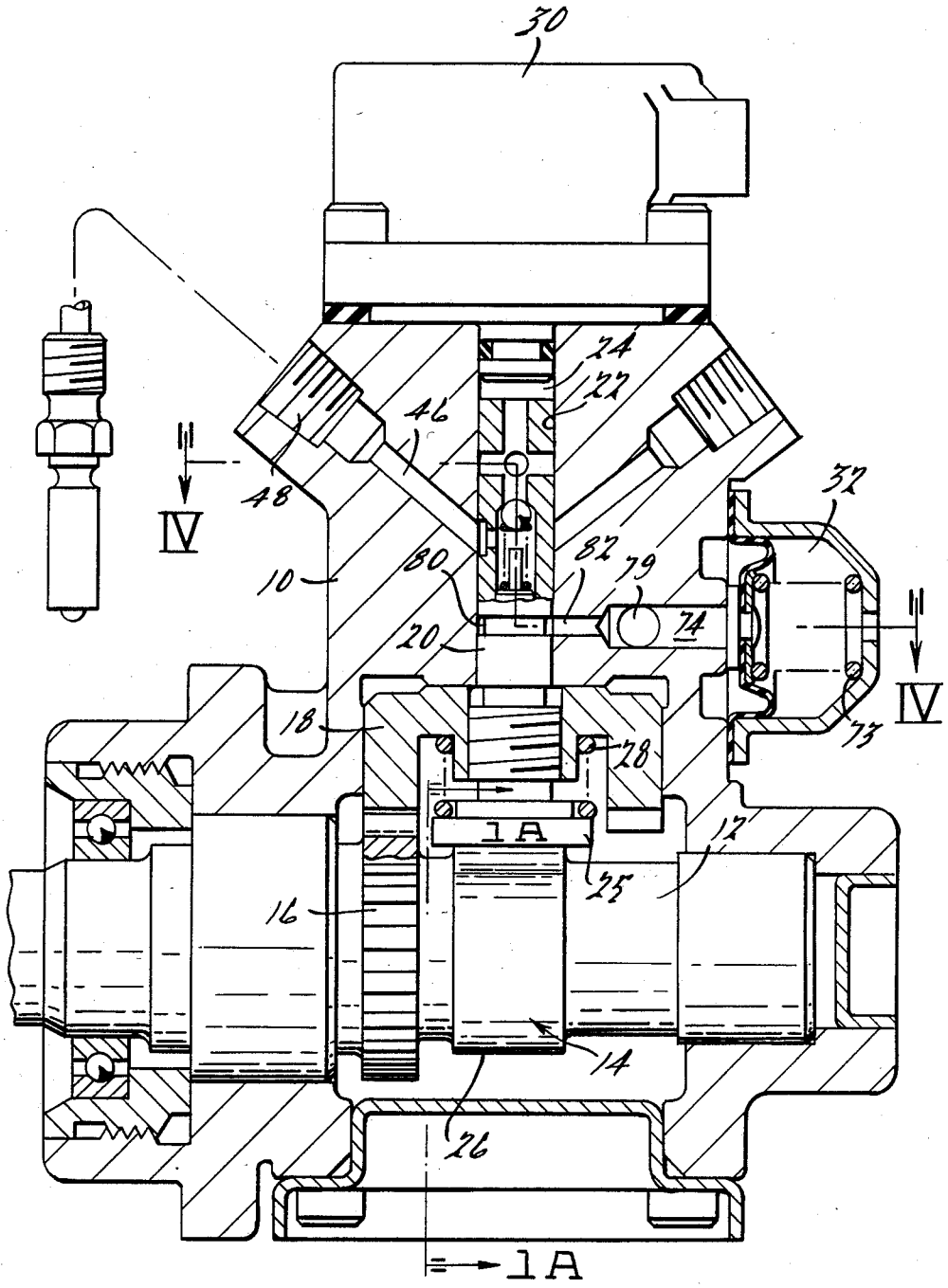
FIG. 1 is a cross-sectional view of a portion of an internal combustion engine embodying the invention.
Figure 1A:
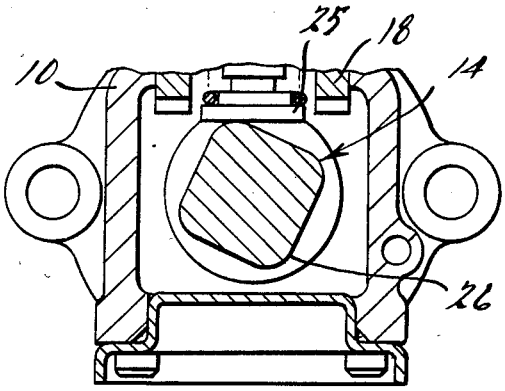
FIG. 1A is a cross-sectional view taken on a plane indicated by and viewed in the direction of the arrows IA—IA of FIG. 1.

FIG. 1 shows a pump housing 10 containing an engine driven camshaft 12 having a cam 14 and a gear 16 integral therewith. Gear 16 meshes with another gear 18 slidably splined to a single plunger 20. The plunger is mounted for a reciprocating movement in a plunger barrel 22. The barrel defines a fuel spill/fill chamber 24 at one end of plunger 20, which has a tappet 25 at its opposite end engagable with the cam. The cam profile, as seen in FIG. 1A, provides for four camlobes 26 in the same plane spaced 90° apart.

The gear ratio between the gears 18 and 16 is 1:1. A return spring 28 assures that the bottom of the tappet 25 is always in contact with the cam. The spring 28 is sandwiched between the gear 18 and the tappet. Therefore, if the splines are straight, spring 28 rotates together with the plunger and gear. A solenoid valve assembly 30 is installed on the top of the pump housing, and a pressure regulator 32 is mounted on the side of the latter.

Rotation of camshaft 14 causes plunger 20 to reciprocate in the plunger barrel and rotate about its axis. Each revolution of the camshaft results in one revolution and four full strokes of the plunger; i.e., four pumping upstrokes and four fuel intake downstrokes.

Figure 3:
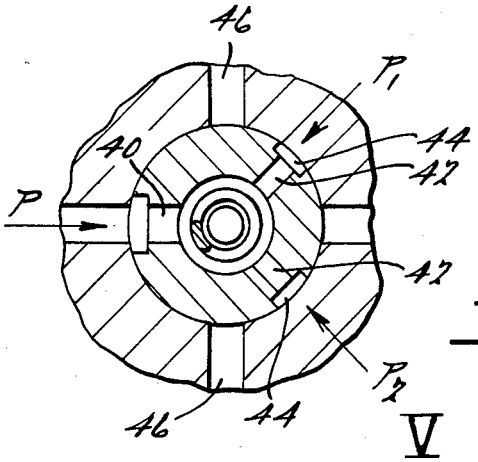
FIGS. 3 and 4 are cross-sectional views taken on planes indicated by and viewed in the direction of the arrows III—III and IV—IV, respectively, in FIGS. 1 and 2.

The plunger has a stepped diameter axial bore 34 containing a ball check valve 36. Two diametrically opposite crossholes 38 at right angles to bore 9 are located above check valve 36, and one crosshole 40 below the valve. Two additional equiangularly located crossholes 42 (FIG. 3) with outside slots 44 provide balance pressure forces $P_1$ and $P_2$, which, during the injection, counteract the force of the injection pressure P and thereby eliminate side loading by P.

Figure 4:
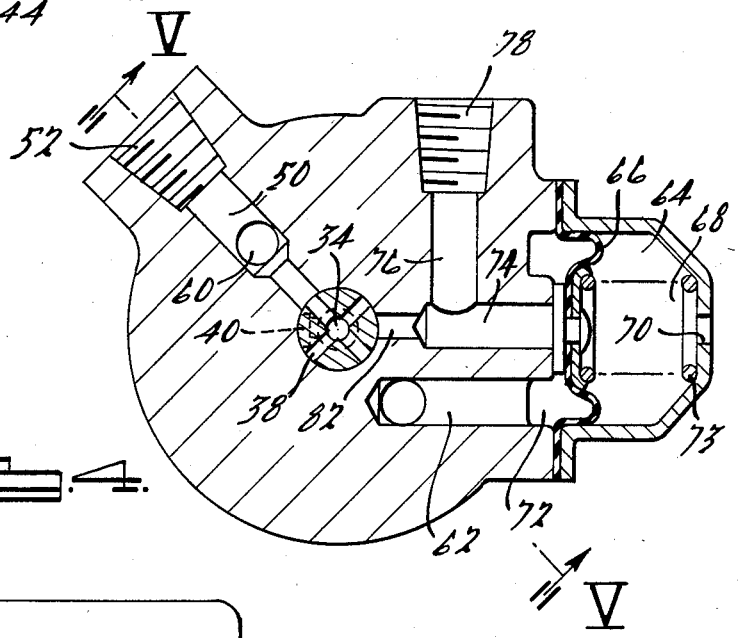

Four injection passages 46 in the housing 10 (FIG. 1) lead to four outlet ports 48. A supply passage 50 leads to inlet port 52 as shown in FIG. 4. The relative arrangement of crossholes 38 and 40 in the plunger and passages 46 and 50 in the housing is such that as seen in FIG. 4, rotation of the plunger 45° from the position shown during each downstroke will align one of the crossholes 38 with the supply passage 50 while disconnecting the crosshole 40 (shown in dotted lines) from any of the injection passages 46. During the next 45° rotational upstroke of the plunger, the crosshole 40 will be aligned with one of the injection passages 46 while the crossholes 38 will be disconnected from the supply passage 50.

Figure 2:
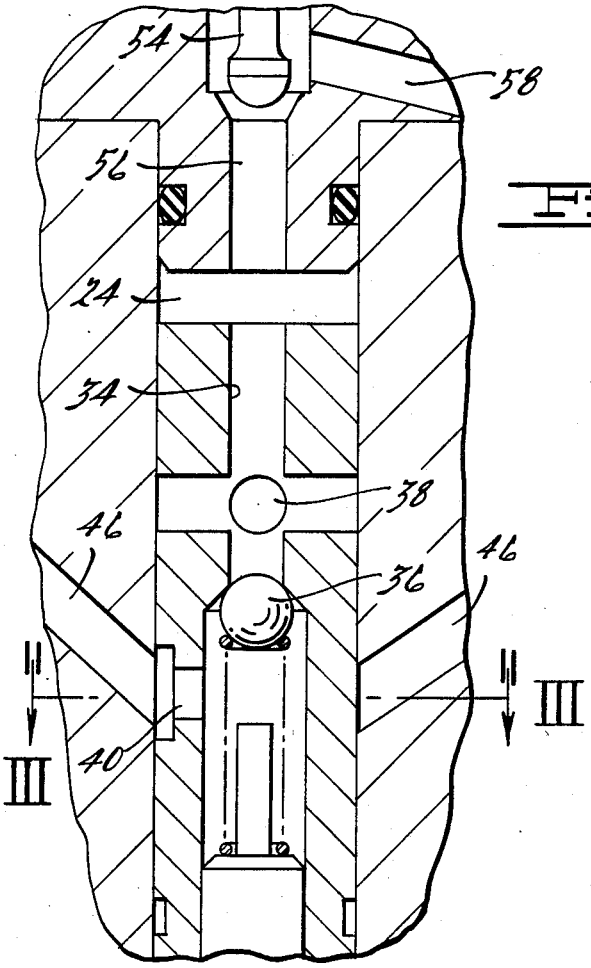
FIG. 2 is an enlarged view of a detail of FIG. 1.

As best seen in FIG. 2, the solenoid valve assembly 30 in FIG. 1 includes a movable solenoid valve 54 controlling fuel flow through a spill port 56 to and from a low pressure pump, not shown, through a passage 58. The spill passage 56 connects the spill valve with the plunger barrel fuel chamber 24. The spill valve is biased open by a spring, or fuel pressure, as the case may be, so long as the solenoid is not engaged.

During the down or fuel intake stroke of plunger 20, the plunger barrel fuel chamber 24 is filled with fuel through the supply passage 50, crosshole 38, and axial bore 34, as well as past the open spill valve 54. During the upstroke of the plunger, fuel is displaced from the plunger barrel fuel chamber 24 through the spill passage 56, open spill valve 54, and passage 58 back into the fuel supply system. Activation of the solenoid during the upstroke causes the spill valve 54 to close the spill passage 56. The fuel trapped in the plunger barrel fuel chamber 24 then opens the check valve 36 and flows through the crosshole 40 and out of the injection passages 46 to one of the outlet ports 48.

Figure 6:
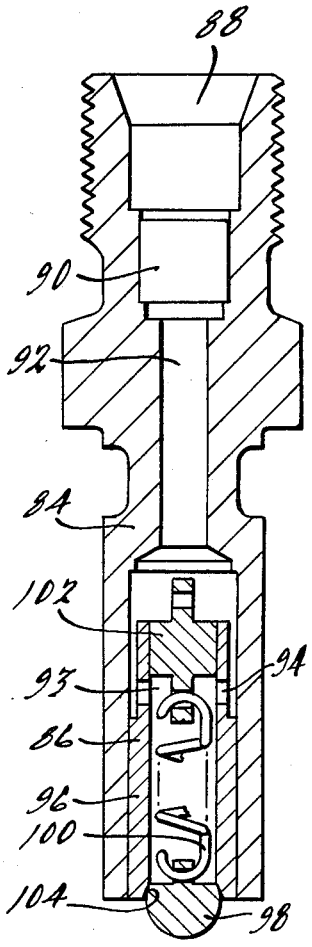
FIG. 6 is a cross-sectional view of a fuel injector for use with the invention.

In an engine system, an injection line would be connected to each of the outlet ports, and an injection nozzle, such as shown in FIG. 6, is attached to the other end of each injection line. Therefore, closure of the spill valve 54 results in fuel injection through the injector nozzle. When the solenoid is deactivated, the spill valve 54 opens, the check valve 36 closes, and the injection is terminated. The quantity of fuel injected is controlled by controlling the duration of solenoid activation. Controlling the timing of solenoid activation controls the injection timing. Because of rotation of the plunger, the crosshole 40 will be connected to a different injection passage 48 during each upstroke of the plunger. Therefore, each revolution of the camshaft results in successive fuel injections through four different nozzles into the air flow to four different engine cylinders.

Figure 5:
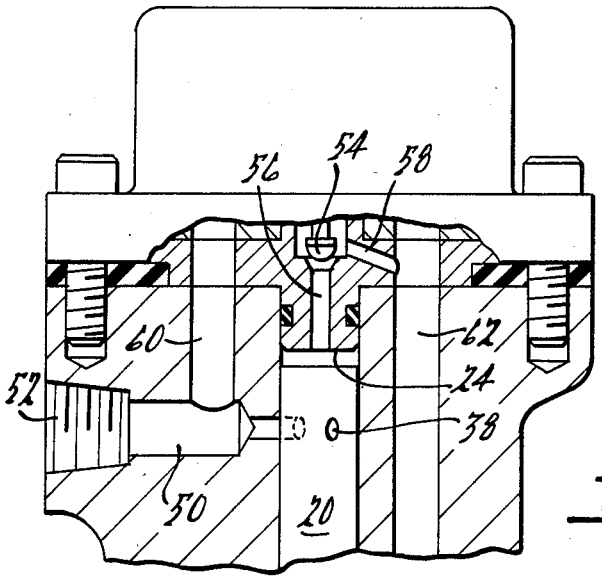
FIG. 5 is a cross-sectional view taken on a plane indicated by and viewed in the direction of the arrows V—V in FIG. 4.
Figure 7:
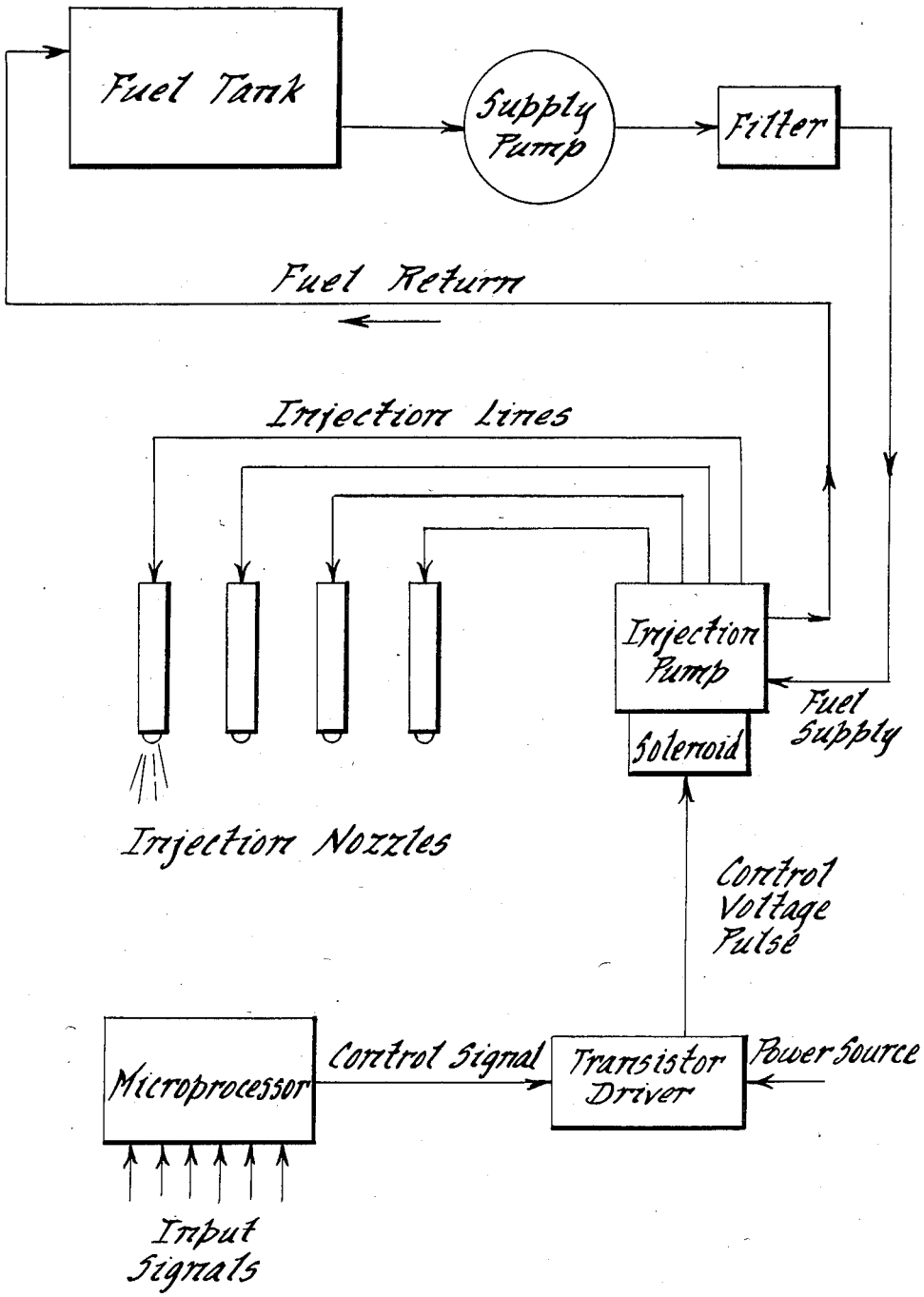
FIG. 7 schematically illustrates a fuel injection system in which the pump shown in connection with FIGS. 1–4 can be used.

FIGS. 4 and 5 illustrate the flow of supply fuel in the pump. The fuel enters the inlet port 52 from the low pressure supply pump, not shown, and, through supply passage 50 fills the plunger barrel fuel chamber 24 during the downstroke of plunger 20. The remainder of the supply fuel flows upwardly through passage 60 into the solenoid housing, where it cools the solenoid coil. From the solenoid, fuel flows downwardly through the passages 58 and 62 into the housing (FIG. 4) of pressure regulator 64. The latter housing includes an annular flexible diaphragm 66 that divides the housing into a spring chamber 68 vented to atmosphere through a vent 70, and a fuel chamber 72 into which the supply fuel discharges. The spring 73 biases the diaphragm against the end of a passage 74 until the fuel pressure becomes high enough to unseat the diaphragm and flow the excess into passage 74. From the pressure regulator, fuel flows through passages 74 and 76 to an outlet port 78 that returns the fuel to a tank. The preload of the spring 73 determines the pressure differential between the passages 62 and 74, and thus determines the supply fuel pressure in the pump. Fuel leaking through the clearance space between the plunger 20 and the plunger barrel 22 is collected in an annulus 80, (FIG. 1), to which is connected a leak-off passage 82 leading to passage 74.

As seen in FIG. 1A, the four camlobes 26 together form an essentially square shape circumferentially. Therefore, each of the four camlobes occupies 90° of the cam circumference, for a 45° upstroke and an equal 45° downstroke. This profile provides more time, however, for fuel injection by providing for slower motion of the plunger on the upward or pumping stroke and faster motion on the downstroke. To match the slowdown on the upstroke and deceleration on the downstroke, corresponding variation in angular velocity of the plunger rotation is often desirable. This can be accomplished by connecting the plunger 20 to gear 18 with helical splines. Axial motion of the plunger 20 relative to the gear 18 then results in relative rotation of the two parts. With proper selection of the helix direction, the plunger 20 can be made to rotate slower than gear 18 during the upstroke and faster than the gear 18 during the downstroke.

The above described pump is for a four-stroke, four-cylinder engine. It is clear, however, that similar pumps can be designed for engines with different numbers of cylinders. In each case, the number of camlobes and the number of outlet ports would be equal to the number of engine cylinders. It should be noted that the number of camlobes equals the number of engine cylinders only if the pump RPM is half of the four-stroke engine RPM. In an engine with an even number of cylinders, the pump can be run with RPM equal to engine RPM. In such a case, the number of camlobes would be half the number of cylinders, and the gear ratio between the pump camshaft and the plunger 1:2.

If the number of engine cylinders is divisible into 4, the pump can be run with twice the engine RPM. In such a case, the number of camlobes would be one-fourth of the number of cylinders, and the gear ratio between the pump camshaft and the plunger 1:4.

The above described pump can operate with a variety of fuel injectors. One example of such a fuel injector is shown in FIG. 6. The injector consists of an injector body 84 and a nozzle assembly 86. The nozzle assembly would be press fitted into the injector through its outlet end, and fuel would flow from one of the injection lines 48 (FIG. 1) through an inlet port 88 past a filter 90 and through a passage 92 and crossholes 94 into a nozzle chamber 95.

The nozzle assembly consists of a nozzle body 96, a valve 98, a spring 100, and a hanger 102. The valve 98 in this case is made from a ball by grinding off two corners and drilling a hole to provide an eyelet to which a spring 100 can be attached. In some cases, when light weight of the valve is important, the lower half of the ball can be cut off.

The nozzle body 96 is tubular in shape and has a conical seat 104 machined on the lower end of its inner diameter. The top of the nozzle body would be crimped or otherwise squeezed around the hanger 102, thus fixing the position of the hanger in body 84. The outer surface of the hanger 102 is knurled. During assembly, the hanger, spring, and valve would be hooked together and pulled through the body 96 until the valve 98 rests on the conical seat 104. A predetermined pulling force would be applied to the hanger while the nozzle body is crimped around it. This provides a permanent preload to the spring, which determines the valve opening pressure.

An example of a positive displacement electronic fuel injection system in which the pump of the invention could be used is shown schematically in FIG. 6. A supply pump delivers fuel from a fuel tank through a filter to the positive displacement injection pump. Excess fuel returns from the injection pump back to the tank through a fuel return line. Several injection lines connect the outlet ports of the pump with a corresponding number of injection nozzles located in the engine air intake system. Each nozzle serves a separate engine cylinder.

An on-board microprocessor receives a number of input signals carrying information such as accelerator pedal position, engine RPM, air and EGR flows, operating temperatures, etc. It computes the required fuel quantity and injection timing, and sends out a succession of control signals with proper frequency and of proper duration and timing. A transistor driver converts each control signal into a control voltage pulse which activates the solenoid in the injection pump. The duration and timing of the voltage pulse determines the fuel quantity and injection timing, respectively. Due to rotation of the plunger in the injection pump, each activation of the solenoid causes fuel injection through a different injection nozzle. In a four-cylinder engine, the solenoid would be activated four times per engine cycle, successively activating the four individual injection nozzles. The sequence in which the nozzles are activated would correspond to the engine firing order and be determined by the order in which the nozzles were connected to the pump outlet ports.

While the invention has been described and shown in its preferred embodiment, it will be clear to those skilled in the arts to which it pertains, that many changes and modifications may be made thereto without departing from the scope of the invention.

I claim:

1. A fuel injection pump of the plunger, spill port type, including a single plunger reciprocably and rotatably mounted in a plunger barrel, an engine driven camshaft having gear means and a number of camlobes thereon for reciprocating and rotating said plunger a number of times for each revolution of the camshaft through a number of pumping upstrokes and fuel intake downstrokes for injecting fuel sequentially into a number of engine cylinders, the plunger barrel defining a fuel fill/spill chamber at the end of the plunger connected to a solenoid valve controlled spill port for pressurization of the chamber during the upstroke of the plunger upon closure of the spill port by the valve, the plunger having a number of internal axially spaced passages connected to the chamber for filling the chamber with fuel on the fuel intake upstroke of the plunger or alternately directing fuel from the chamber to a fuel injection nozzle during pressurization of the chamber, means connecting one of the internal passages to a fuel supply passage and another passage to a fuel injection nozzle line past a check valve in the other passage, the passages being spaced such that rotation and reciprocation of the plunger through one stroke connects the chamber to one passage which disconnecting the chamber from the other passage, and vice-versa during the next successive stroke of the plunger, the other passage being connected successively one at a time to each injection line in the engine upon rotation of the camshaft, the engine having at least four cylinders, and the camshaft having four camlobes on a single cam, the lobes each being 90° in extent with a peak and an essentially long flat surface inbetween peaks providing a slower upstroke of the plunger than the downstroke thereby providing a longer time for injection than for fuel intake.

2. A fuel injection pump of the plunger, spill port type, including a single plunger reciprocably and rotatably mounted in a plunger barrel, an engine driven camshaft having gear means and a number of camlobes thereon for reciprocating and rotating said plunger a number of times for each revolution of the camshaft through a number of pumping upstrokes and fuel intake downstrokes for injecting fuel sequentially into a number of engine cylinders, the plunger barrel defining a fuel fill/spill chamber at the end of the plunger connected to a solenoid valve controlled spill port for pressurization of the chamber during the upstroke of the plunger upon closure of the spill port by the valve, the plunger having a number of internal axially spaced passages connected to the chamber for filling the chamber with fuel on the fuel intake upstroke of the plunger or alternately directing fuel from the chamber to a fuel injection nozzle during pressurization of the chamber, means connecting one of the internal passages to a fuel supply passage and another passage to a fuel injection nozzle line past a check valve in the other passage, the passages being spaced such that rotation and reciprocation of the plunger through one stroke connects the chamber to one passage which disconnecting the chamber from the other passage, and vice-versa during the next successive stroke of the plunger, the other passage being connected successively one at a time to each injection line in the engine upon rotation of the camshaft, the one internal passage comprising two crossbores at right angles to each other providing four ports 90° apart, the other passage being a single passage located circumferentially 45° between two of the four ports whereby rotation of the plunger in 45° increments and reciprocating the plunger first aligns one of the ports of the one passage with the supply passage while the other port is blocked from communication with an injection line, successive rotation of the plunger 45° during the uppumping stroke connecting the other port to an injection line and disconnecting the one port from the supply passage thereby permitting pressurization of fuel in the chamber upon closure of the spill valve with the subsequent opening of the check valve.

3. A fuel injection pump of the plunger, spill port type, including a single plunger reciprocably and rotatably mounted in a plunger barrel, an engine driven camshaft having gear means and a number of camlobes thereon for reciprocating and rotating said plunger a number of times for each revolution of the camshaft through a number of pumping upstrokes and fuel intake downstrokes for injecting fuel sequentially into a number of engine cylinders, the plunger barrel defining a fuel fill/spill chamber at the end of the plunger connected to a solenoid valve controlled spill port for pressurization of the chamber during the upstroke of the plunger upon closure of the spill port by the valve, the plunger having a number of internal axially spaced passages connected to the chamber for filling the chamber with fuel on the fuel intake upstroke of the plunger or alternately directing fuel from the chamber to a fuel injection nozzle during pressurization of the chamber, means connecting one of the internal passages to a fuel supply passage and another passage to a fuel injection nozzle line past a check valve in the other passage, the passages being spaced such that rotation and reciprocation of the plunger through one stroke connects the chamber to one passage which disconnecting the chamber from the other passage, and vice-versa during the next successive stroke of the plunger, the other passage being connected successively one at a time to each injection line in the engine upon rotation of the camshaft, the one internal passage consist ing of four supply ports spaced 90° apart, the injection lines including four lines spaced 90° apart and aligned one at a time with the other port upon each 90° rotation of the plunger on its upstroke and misaligned upon 45° rotation of the plunger during its downstroke, the supply ports being aligned successively one at a time each 90° plunger rotation on its downstroke with the supply passages and misaligned with the supply passage upon a 45° rotation of the plunger on its upstroke.

* * * * *